US009840087B2

(12) United States Patent
Hoshii

(10) Patent No.: US 9,840,087 B2
(45) Date of Patent: Dec. 12, 2017

(54) LIQUID EJECTING APPARATUS AND LIQUID EJECTING METHOD

(71) Applicant: Seiko Epson Corporation, Tokyo (JP)

(72) Inventor: Jun Hoshii, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/072,465

(22) Filed: Mar. 17, 2016

(65) Prior Publication Data

US 2016/0288491 A1 Oct. 6, 2016

(30) Foreign Application Priority Data

Mar. 30, 2015 (JP) ..... 2015-068260

(51) Int. Cl.
*B41J 2/205* (2006.01)
*B41J 2/21* (2006.01)

(52) U.S. Cl.
CPC ..... *B41J 2/2054* (2013.01); *B41J 2/2139* (2013.01); *B41J 2/2142* (2013.01)

(58) Field of Classification Search
CPC ..... B41J 2/2054; B41J 2/2142; B41J 2/2139
See application file for complete search history.

(56) References Cited

U.S. PATENT DOCUMENTS

2006/0125860 A1* 6/2006 Arazaki ..... B41J 2/0451 347/12

FOREIGN PATENT DOCUMENTS

JP 2005-246840 A 9/2005

* cited by examiner

*Primary Examiner* — Justin Seo
(74) *Attorney, Agent, or Firm* — Harness, Dickey & Pierce, P.L.C.

(57) ABSTRACT

A printer includes an ejecting head, and a printing control section, in which the ejecting head ejects ink onto the sheet while performing scanning of a plurality of times with respect to a predetermined raster line which extends in the scanning direction. In addition, the printing control section sets a nozzle use rate of a first complementing nozzle which is higher than a nozzle use rate in normal operation as a nozzle use rate of a complementing nozzle which ejects ink to a pixel to which a defective nozzle should eject ink on the sheet, instead of the defective nozzle, when the defective nozzle is detected, and sets a nozzle use rate of a second complementing nozzle which is lower than that of the first complementing nozzle as a nozzle use rate of a supplementary complementing nozzle which is the peripheral nozzle of the complementing nozzle.

5 Claims, 13 Drawing Sheets

FIG. 6

| RANGE OF COMPLEMENTING NOZZLE | FIRST PASS | USE RATE (%) | SECOND PASS | USE RATE (%) | TOTAL USE RATE (%) |
|---|---|---|---|---|---|
| #0 | DEFECTIVE NOZZLE | 0 | COMPLEMENTING NOZZLE | 100 | 100 |
| #1 | PERIPHERAL NOZZLE | 5 | SUPPLEMENTARY COMPLEMENTING NOZZLE | 95 | 100 |
| #2 | PERIPHERAL NOZZLE | 22 | SUPPLEMENTARY COMPLEMENTING NOZZLE | 78 | 100 |
| #3 | PERIPHERAL NOZZLE | 50 | SUPPLEMENTARY COMPLEMENTING NOZZLE | 50 | 100 |
| #4 | PERIPHERAL NOZZLE | 78 | SUPPLEMENTARY COMPLEMENTING NOZZLE | 22 | 100 |
| #5 | PERIPHERAL NOZZLE | 95 | SUPPLEMENTARY COMPLEMENTING NOZZLE | 5 | 100 |

LIQUID EJECTING APPARATUS AND LIQUID EJECTING METHOD

BACKGROUND

1. Technical Field

The present invention relates to a liquid ejecting apparatus and a liquid ejecting method.

2. Related Art

As an example of a liquid ejecting apparatus, a serial-type ink jet printer which performs printing on a medium by ejecting ink as an example of liquid onto the medium while moving an ejecting head in a scanning direction which intersects a transport direction of the medium is known. In such a printer, in a case in which a so-called non-ejecting nozzle (defective nozzle) in which ejection is not performed as intended by the nozzle due to mixing of dust or air bubbles into a nozzle is present, in order to resolve deterioration in image quality due to the non-ejecting nozzle, a non-ejecting complementing control operation, in which complementing is performed by ejecting ink to a region corresponding to a pixel to which the non-ejecting nozzle should eject ink using a substitute nozzle other than the non-ejecting nozzle, is executed.

An ink jet recording apparatus (liquid ejecting apparatus) in JP-A-2005-246840 performs multipass printing in which printing of one raster line is performed by repeating a movement of an ejecting head in a scanning direction, ejecting ink, and transporting a medium by a predetermined distance. In addition, in the liquid ejecting apparatus, when a non-ejecting nozzle is detected in the ejecting head, a plurality of substitute nozzles which perform non-ejecting complementing control are selected, and printing of a pixel which is to be recorded using the non-ejecting nozzle is performed by dispersing the ink in these substitute nozzles.

Meanwhile, in a liquid ejecting apparatus in the related art such as that in JP-A-2005-246840, as illustrated in FIG. 12A, for example, in a case in which a nozzle No. 4 of an ejecting head 200 is detected as a defective nozzle, and a nozzle No. 9 is selected as a substitute nozzle, as illustrated in FIG. 12B, during scanning of the first pass of the ejecting head 200, nozzles No. 1 to 3 and 5, which can eject ink, form dots DT on a medium S (refer to FIG. 12A); however, the nozzle No. 4, which is the defective nozzle, does not form a dot DT on the medium S.

In such a case, in the liquid ejecting apparatus in JP-A-2005-246840, as illustrated in FIG. 13A, in a case in which nozzles No. 6 to 10 form dots DT in a region adjacent to dots DT, which are formed using nozzles No. 1 to 5 on the medium S during scanning of the second pass of the ejecting head 200 after the medium S is transported by a predetermined distance, a dot DT is formed when the nozzle No. 9 ejects ink to a region corresponding to a pixel to which ink is to be ejected using the nozzles No. 4 on the medium S.

However, as illustrated in FIG. 13B, when a position of a medium S with respect to the ejecting head 200 in a transport direction is shifted due to a transport error at a time of scanning of the second pass of the ejecting head 200, the nozzle No. 9 ejects ink to a region on the medium S corresponding to a pixel of the nozzle No. 3, even though the nozzle No. 9 was originally to eject ink to a region on the medium S corresponding to a pixel of the nozzle No. 4. For this reason, an amount of ink of a dot DT formed in the region on the medium S corresponding to the pixel of the nozzle No. 3 increases excessively, and an amount of ink in the region on the medium S corresponding to the pixel of the nozzle No. 4 is zero. As a result, since the difference in the amount of ink between the region on the medium S corresponding to the pixel to which ink is to be ejected using the defective nozzle (nozzle No. 4) and the peripheral region thereof becomes large, there is a concern that image quality may deteriorate.

SUMMARY

An advantage of some aspects of the invention is to suppress deterioration in image quality in a case in which a region corresponding to a pixel to which a defective nozzle should eject liquid onto a medium is complemented with liquid which is ejected using a complementing nozzle.

Hereinafter, aspects of the invention, and operational effects thereof will be described.

A liquid ejecting apparatus includes an ejecting head which includes nozzle columns formed by aligning nozzles which can eject liquid onto a medium; a moving section which causes the ejecting head to move relative to the medium; an abnormal ejecting detection section which detects a defective nozzle, which is an abnormal nozzle; and a control section which controls operations of the ejecting head and the moving section, in which the ejecting head can eject the liquid onto the medium while performing scanning of a plurality of times with respect to a predetermined raster line which extends in a direction intersecting the nozzle columns, and in a case in which a defective nozzle is detected, the control section sets a nozzle use rate of a first complementing nozzle which is higher than a nozzle use rate in normal operation as a nozzle use rate of a complementing nozzle other than the defective nozzle, which forms a raster line to which the defective nozzle is allocated, and sets a nozzle use rate of a second complementing nozzle which is lower than the nozzle use rate of the first complementing nozzle as a nozzle use rate of a peripheral nozzle of the complementing nozzle.

According to the configuration, even if a region corresponding to a pixel to which a defective nozzle should eject liquid onto a medium is shifted with respect to the previous pass, and liquid is not ejected to the region by using a complementing nozzle, when a position of the medium with respect to an ejecting head is shifted due to an error in transporting the medium, or the like, for example, it is possible to eject liquid to the region by using the peripheral nozzle of the complementing nozzle. For this reason, since it is possible to prevent a difference in the amount of liquid between a dot formed in a region corresponding to a pixel to which a defective nozzle should eject ink onto a medium and a dot formed in the peripheral region thereof from becoming large, lightness and darkness of dots formed on the medium can be decreased, and it is possible to suppress deterioration in image quality. In addition, by definition, a defective nozzle includes a nozzle which ejects an amount of liquid smaller than that of a normal nozzle as well as a nozzle which is incapable of ejecting liquid at all.

In the liquid ejecting apparatus, it is preferable that the control section set a nozzle use rate of the first complementing nozzle so that a total of a nozzle use rate of the first complementing nozzle and a nozzle use rate of the defective nozzle when the ejecting head ejects liquid while performing scanning of a plurality of times becomes equal to a total of nozzle use rates in normal operation when the ejecting head ejects the liquid while performing scanning of a plurality of times.

According to the configuration, when a position of a medium with respect to the ejecting head is not shifted due to an error in transporting the medium, or the like, for example, an amount of liquid of a dot formed using a normal nozzle and an amount of liquid of a dot formed in a region corresponding to a pixel to which a defective nozzle should eject liquid on the medium become equal. For this reason, it is possible to reduce the variation in the amount of liquid between a region corresponding to the pixel to which the defective nozzle should eject ink on the medium and a region to which a normal nozzle ejects ink.

In the liquid ejecting apparatus, it is preferable that the control section set a nozzle use rate of a peripheral nozzle which is lower than that of the nozzle use rate in normal operation as a nozzle use rate of the peripheral nozzle of the defective nozzle.

According to the configuration, a dot formed of a small amount of liquid is formed when the peripheral nozzle with a low nozzle use rate ejects liquid to the peripheral region of the region corresponding to the pixel to which the defective nozzle should eject liquid on the medium. In addition, even when a position of the medium with respect to the ejecting head is shifted thereafter, and a complementing nozzle ejects liquid to the peripheral region on the medium, it is possible to prevent the amount of liquid of the dot formed in the peripheral region from being excessively increased. Accordingly, it is possible to reduce the variation in the amount of liquid between the dot formed in the region corresponding to the pixel to which the defective nozzle should eject liquid on the medium and the dot formed in the peripheral region thereof.

In the liquid ejecting apparatus, it is preferable that the control section set the nozzle use rate of the peripheral nozzle to be high when the peripheral nozzle is separated from the defective nozzle in a nozzle column direction, and set the nozzle use rate of the second complementing nozzle to be low when the second complementing nozzle is separated from the complementing nozzle in the nozzle column direction.

According to the configuration, even when a position of a medium with respect to the ejecting head is shifted due to an error in transporting the medium, or the like, for example, it is possible to further reduce the variation in the respective amounts of liquid of the dot formed in a region corresponding to the pixel to which the defective nozzle should eject liquid on a medium and of the dot formed in the peripheral region thereof.

In the liquid ejecting apparatus, it is preferable that the control section set the nozzle use rate of the second complementing nozzle and the nozzle use rate of the peripheral nozzle so that a total of the nozzle use rate of the second complementing nozzle and the nozzle use rate of the peripheral nozzle when the ejecting head ejects the liquid while performing scanning of a plurality of times becomes equal to a total of the nozzle use rates in normal operation when the ejecting head ejects the liquid while performing scanning of a plurality of times.

According to the configuration, when a position of a medium with respect to the ejecting head is not shifted due to an error in transporting the medium, or the like, for example, an amount of liquid of a dot formed using a normal nozzle and an amount of liquid of a dot formed in the peripheral region of the region corresponding to the pixel to which the defective nozzle should eject liquid on the medium become equal. For this reason, it is possible to suppress the variation in the amount of liquid in each dot.

In the liquid ejecting apparatus, it is preferable that the control section set a nozzle use rate in normal operation so that a nozzle use rate of nozzles in the nozzle column decreases from a nozzle at the center toward a nozzle at an end.

According to the configuration, in a case in which a position of a medium with respect to the ejecting head is shifted due to an error in transporting the medium, for example, it is possible to reduce the degree of influence of the shifting compared to a case in which the nozzle use rate of a nozzle column is constant.

In the liquid ejecting apparatus, it is preferable that the control section set a plurality of the complementing nozzles and set respective nozzle use rates of the plurality of complementing nozzles so that a total of the nozzle use rates of the plurality of complementing nozzles becomes equal to the nozzle use rate of the first complementing nozzle.

According to the configuration, since a plurality of complementing nozzles are set, it is possible to prevent a nozzle use rate of one complementing nozzle from becoming excessively high. For this reason, it is possible to suppress shortening of the service life of the complementing nozzle.

In the liquid ejecting apparatus, it is preferable that the control section increase the number of scanning times previously set for the ejecting head to form the raster line in a case in which the defective nozzle is present and in which it is not possible to set a complementing nozzle which complements the defective nozzle.

According to the configuration, even when a nozzle which can place liquid droplets on the same pixel as the pixel to which the defective nozzle should eject liquid is the defective nozzle, it is possible to set a nozzle other than the nozzle to be a complementing nozzle by increasing the number of scanning times of the ejecting head. For this reason, it is possible to eject liquid to a pixel to which a defective nozzle should eject liquid using a complementing nozzle.

A liquid ejecting method in a liquid ejecting apparatus which includes an ejecting head which includes nozzle columns formed by aligning nozzles which can eject liquid onto a medium, a moving section which causes the ejecting head to move relative to the medium, and an abnormal ejecting detection section which detects a defective nozzle which is an abnormal nozzle, in which the ejecting head can eject the liquid onto the medium while performing scanning of a plurality of times with respect to a predetermined raster line which extends in a direction intersecting the nozzle columns, the method including setting a nozzle use rate of a first complementing nozzle which is higher than a nozzle use rate in normal operation as a nozzle use rate of a complementing nozzle other than the defective nozzle, which forms a raster line to which the defective nozzle is allocated and setting a nozzle use rate of a second complementing nozzle which is lower than that of the first complementing nozzle as a nozzle use rate of a peripheral nozzle of the complementing nozzle, in a case in which the defective nozzle is detected.

According to the configuration, even when a region corresponding to a pixel to which a defective nozzle should eject liquid on a medium is shifted with respect to the previous pass, and when it is not possible to eject liquid to the region by using a complementing nozzle, when a position of the medium with respect to a ejecting head is shifted due to an error in transporting the medium, for example, it is possible to eject liquid to the region by using the peripheral nozzle of the complementing nozzle. For this reason, it is possible to suppress deterioration in image quality since the difference in the amount of liquid between a dot formed in the region corresponding to the pixel to which the defective nozzle should eject liquid on the medium and a dot formed in the peripheral region thereof is suppressed so as not to become large.

BRIEF DESCRIPTION OF THE DRAWINGS

The invention will be described with reference to the accompanying drawings, wherein like numbers reference like elements.

FIG. 6 is a table which illustrates a relationship of nozzle use rates among a defective nozzle, the peripheral nozzle, a complementing nozzle, and a supplementary complementing nozzle in the liquid ejecting apparatus.

FIGS. 10A to 10C are diagrams for describing operations of the liquid ejecting apparatus, and in which FIGS. 10A and 10B are schematic views which illustrate a part of a nozzle column, and FIG. 10C is a schematic view which illustrates dots which are formed on a sheet using an ejecting head.

DESCRIPTION OF EXEMPLARY EMBODIMENTS

Hereinafter, one embodiment of a liquid ejecting apparatus will be described with reference to the drawings. In addition, the liquid ejecting apparatus according to the embodiment is configured as, for example, an ink jet printer which performs printing by ejecting ink as an example of liquid onto a medium. In addition, the printer is a so-called serial-type printer with a printing system with which printing is performed by moving a carriage (ejecting head) in a direction intersecting a transport direction of a medium.

Figure 1:
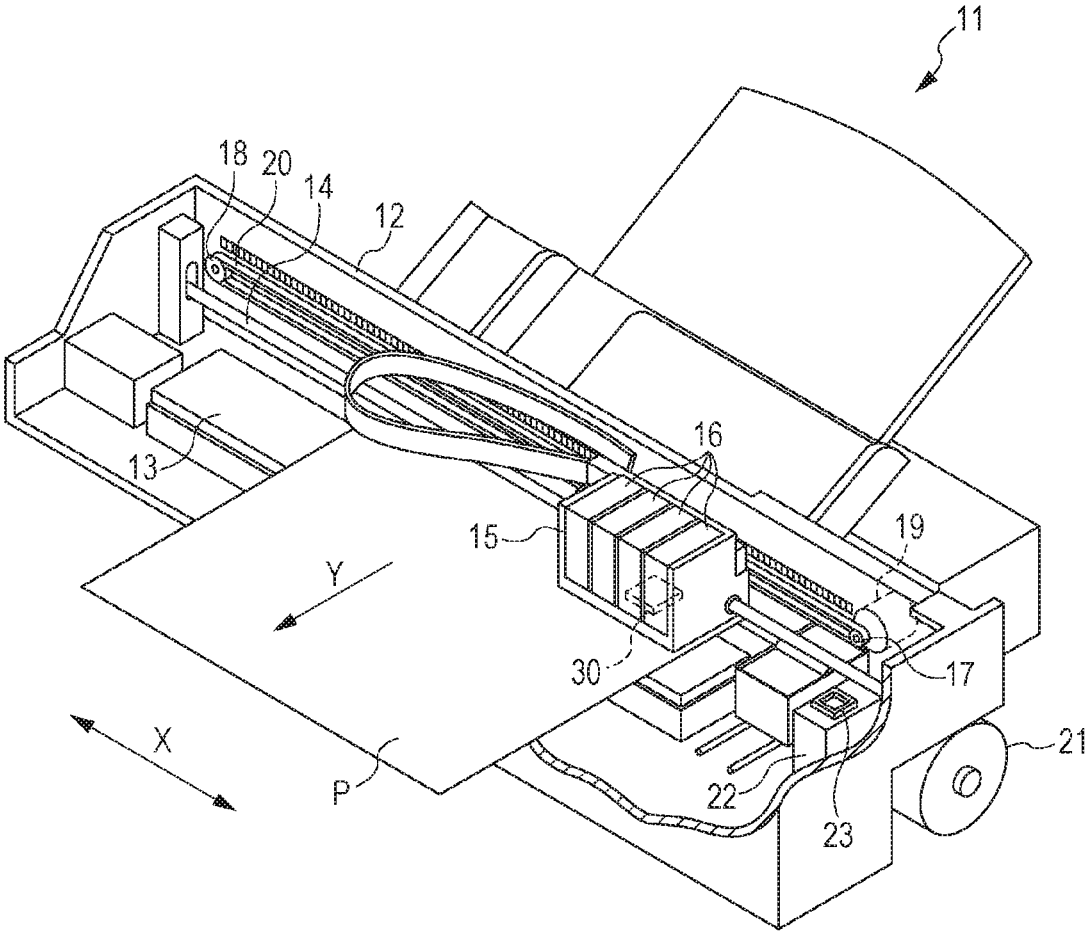
FIG. 1 is a perspective view of one embodiment of a liquid ejecting apparatus.

As illustrated in FIG. 1, a printer 11 as an example of the liquid ejecting apparatus includes a lower box-shaped frame 12 of which a part including the upper part is opened, and a supporting table 13 which supports a sheet P as an example of a medium is arranged on a base portion of the frame 12. A guide member 14 which extends in a longitudinal direction of the supporting table 13 is extended at a position on the upper part of the supporting table 13 in a state in which both end portions are supported by the frame 12. A carriage 15 as an example of a moving section is supported by the guide member 14 so as to reciprocate in a scanning direction X. In the carriage 15, an ejecting head 30 is provided at a position at which the ejecting head can face the supporting table 13. In addition, a plurality of liquid containers 16 (four in the embodiment) which accommodate ink are detachably mounted on the carriage 15.

In addition, as an example, black (K), cyan (C), magenta (M), and yellow (Y) ink is accommodated in the four liquid containers 16. Printing can be performed when ink supplied from each liquid container 16 is ejected onto a sheet P from the ejecting head 30 while moving in the scanning direction X along with the carriage 15.

A driving pulley 17 and a driven pulley 18 are rotatably supported at both end portions of the frame 12, which are separated by a predetermined distance in the scanning direction X. An output shaft of a carriage motor 19 as a driving source of the carriage 15 is connected to the driving pulley 17. An endless timing belt 20 is placed on the pair of pulleys 17 and 18. When a driving force of the carriage motor 19 is transmitted to the carriage 15 through the timing belt 20, the carriage 15 reciprocates in the scanning direction X while being guided by the guide member 14.

In addition, in the printer 11, a transport motor 21 and various rollers, which are rotated using a driving force from the transport motor 21, are provided. In addition, when each roller rotates using the driving force of the transport motor 21, a sheet P is transported onto the supporting table 13 in a transport direction Y which is a direction intersecting (orthogonal, preferably) the scanning direction X.

In addition, in the inside of the frame 12, a maintenance device 22 for performing maintenance of the ejecting head 30 is provided in a non-printing region as one end portion in a region in which the carriage 15 moves. That is, in the non-printing region, it is possible to perform brushing in which ink is ejected into a cap 23 from the ejecting head 30, cleaning in which ink is discharged from an ink supply system through the ejecting head 30, and the like.

Figure 2A:
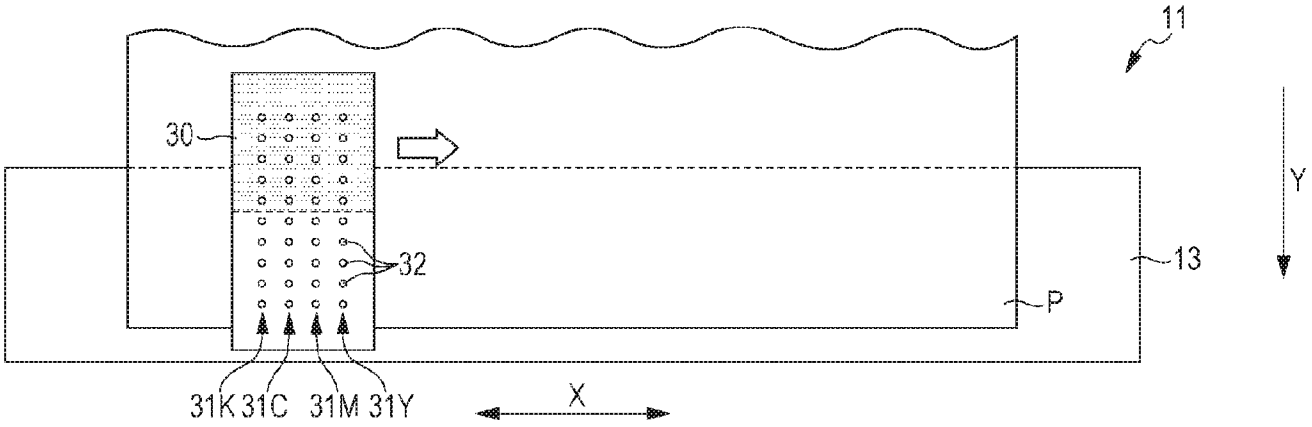
FIGS. 2A and 2B are planar schematic views which illustrate an ejecting head in the liquid ejecting apparatus, and the periphery thereof.
Figure 2B:
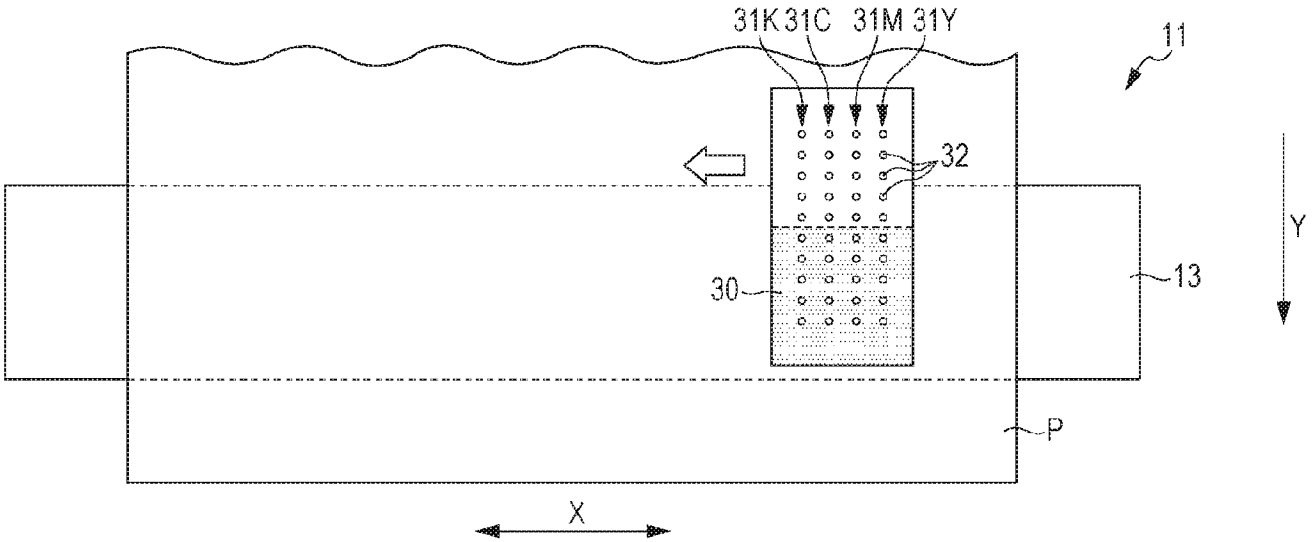

As illustrated in FIGS. 2A and 2B, a plurality of (four in the embodiment) nozzle columns 31K, 31C, 31M, and 31Y, which are formed of a plurality of nozzles 32 aligned in the transport direction Y at a constant nozzle pitch, are formed on a nozzle forming face as a base of the ejecting head 30. These nozzle columns 31K, 31C, 31M, and 31Y are arranged at intervals in the scanning direction X. In addition, in FIGS. 2A and 2B, only ten nozzles 32 are illustrated in order to simplify the figures; however, in practice, the respective nozzle columns 31K, 31C, 31M, and 31Y are formed of 360 nozzles 32, for example. In addition, in FIGS. 2A and 2B, each nozzle 32 is denoted by a solid line for ease of description. In addition, the nozzle columns 31K, 31C, 31M, and 31Y can eject ink of four colors of black (K), cyan (C), magenta (M), and yellow (Y), respectively. An abnormal ejecting detection section 33 (refer to FIG. 4) which detects driving elements (not illustrated) of the same number as the nozzle 32 and which detects residual vibration of the driving elements are provided in the ejecting head 30. In addition, the abnormal ejecting detection section 33 detects damped vibration of a vibrating plate (not illustrated) which vibrates due to driving of the driving element as residual vibration. In this manner, a nozzle among nozzles 32 in which intended ejection of ink is not performed (hereinafter, referred to as "defective nozzle") is detected. In addition, the defective nozzle is considered an abnormal nozzle, for example, a nozzle which ejects only an amount of ink which is smaller than an amount of ink which is ejected from a normal nozzle, in addition to a nozzle from which ink is not ejected at all.

Figure 4:
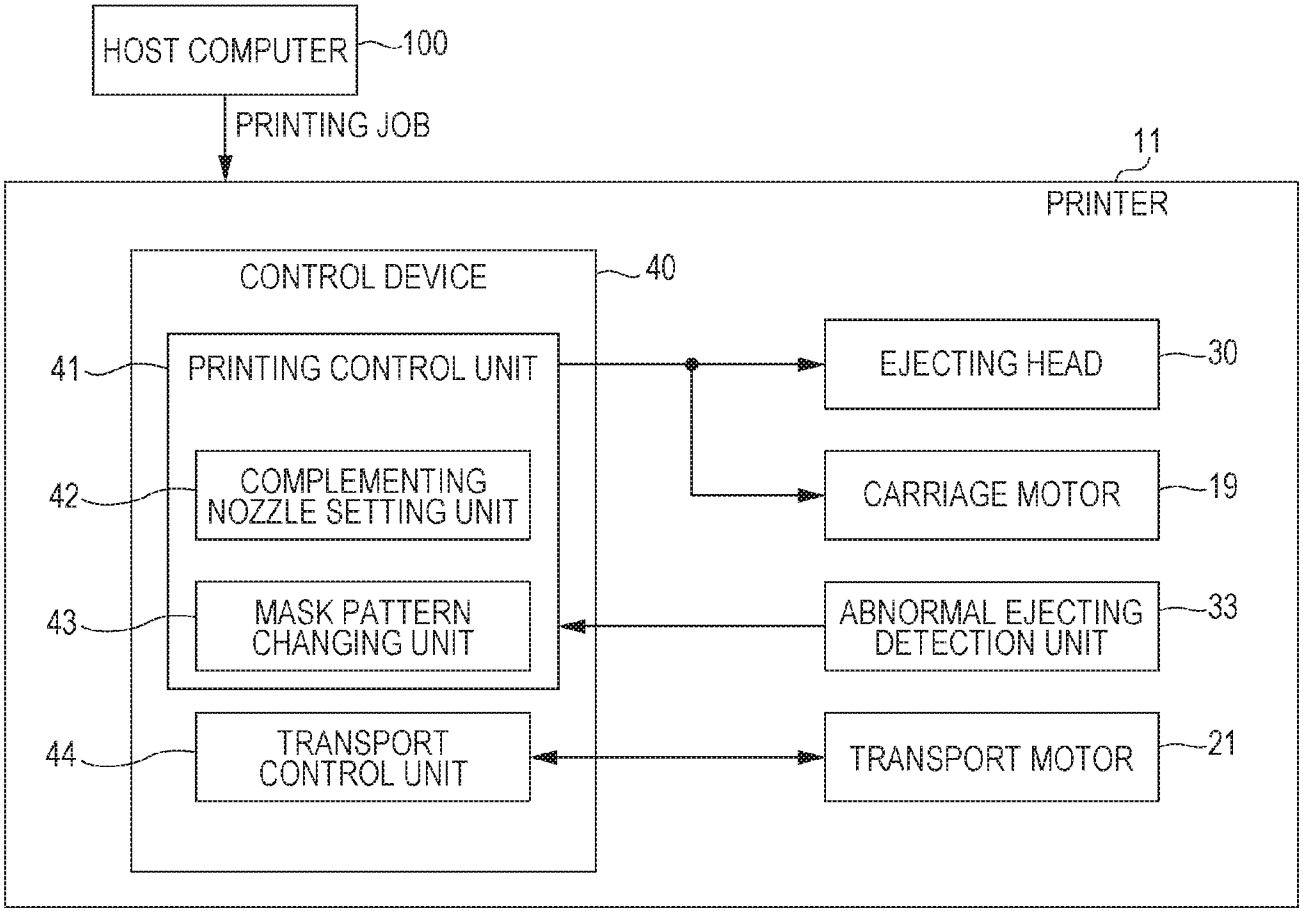
FIG. 4 is a block diagram which illustrates a control configuration of the liquid ejecting apparatus.

In the printer 11 with such a configuration, the ejecting head 30 ejects ink which is supplied from the liquid container 16 (refer to FIG. 1) onto a sheet P, which is transported to the supporting table 13, from each nozzle 32 while moving in the scanning direction X each time printing data of a raster line of one column, which is rasterized as a printing job, is received from a host computer 100 (refer to FIG. 4). Printing of an image, or the like, is performed on a sheet P by repeating this job.

In addition, the printer 11 includes a one-pass printing mode in which printing is performed on a sheet P while causing the ejecting head 30 to perform one forward scanning movement or one backward scanning movement in the scanning direction X with respect to a raster line of one column extending in a direction intersecting (orthogonal in the embodiment) the nozzle columns 31K, 31C, 31M, and 31Y, and a multipass printing mode in which printing is performed on a sheet P while causing the ejecting head 30 to perform a plurality of scanning movements in the scanning direction X with respect to a raster line of one column.

In a case of a printing mode of two passes in particular, in the multipass printing mode, as illustrated in FIG. 2A, the printer 11 performs printing of the second pass using the ejecting head 30 after transporting a sheet P in the transport direction Y by a distance of approximately one half the width of the ejecting head 30, as illustrated in FIG. 2B, after completing printing of the first pass using the ejecting head 30. For this reason, a predetermined raster line on a sheet P is formed using a plurality of nozzle regions of nozzles 32 which execute printing of the first pass (nozzles in shaded region in FIG. 2A) and nozzles 32 which execute printing of the second pass (nozzles in shaded region in FIG. 2B).

Figure 3A:
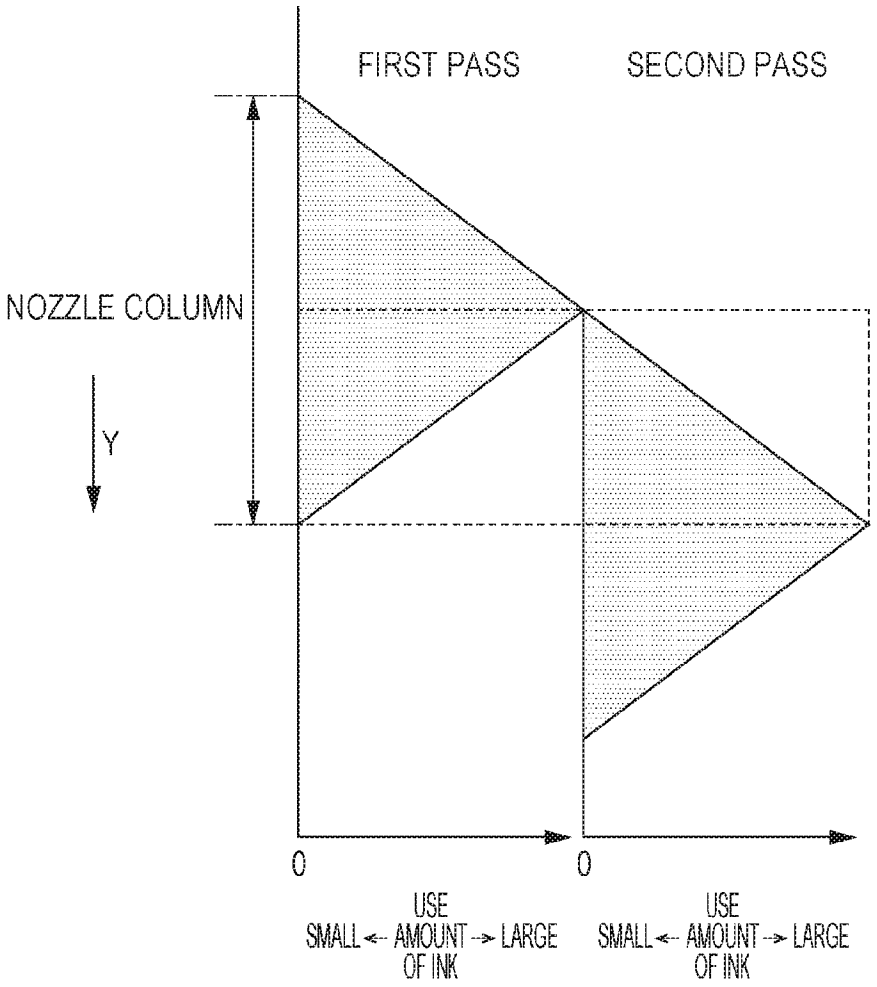
FIG. 3A is a schematic view which illustrates a relationship between a nozzle column and a use amount of ink in a case in which a defective nozzle is not detected, in the liquid ejecting apparatus.
Figure 3B:
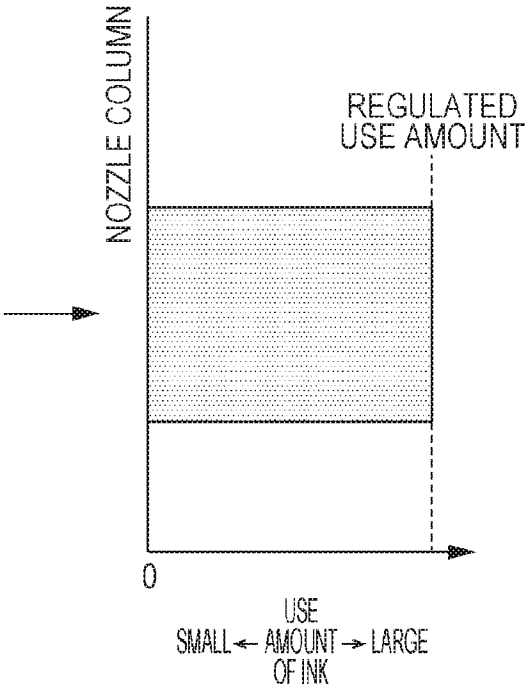
FIG. 3B is a schematic view which illustrates a relationship between a nozzle column in a region which is illustrated using a dashed line in FIG. 3A and a total use amount of ink in the first pass and the second pass.

As illustrated in FIG. 3A, when image data for ejecting ink to all pixels is input, in the nozzle column 31K (refer to FIGS. 2A and 2B) of the ejecting head 30, a use amount of ink is largest at the center of the nozzle column 31K in the transport direction Y, and the use amount of ink gradually decreases toward both ends of the nozzle column 31K. In addition, as illustrated in FIG. 3A, since a sheet P is transported by a half of the full length of the nozzle column 31K in the transport direction Y, in the nozzle column 31K in the second pass, a region in which a center nozzle 32 in the transport direction Y of the nozzle column 31K in the first pass performs ejecting on a sheet P, and a region in which a nozzle 32 at an end on the upstream side in the transport direction Y of the nozzle column 31K in the second pass performs ejecting on the sheet P become the same region. In addition, a region in which a nozzle 32 at an end on the downstream side in the transport direction Y of the nozzle column 31K in the first pass performs ejecting on the sheet P, and a region in which the center nozzle 32 in the transport direction Y of the nozzle column 31K in the second pass performs ejecting on the sheet P become the same region. In this manner, as illustrated in FIG. 3B, in a rectangular region denoted by a dashed line in FIG. 3A, for example, an amount of ink in a region in which the nozzle 32 in the first pass and the nozzle 32 in the second pass overlap in the transport direction Y becomes equal to a regulated use amount which is a necessary amount of ink in the region. That is, when the ratio of an amount of ink which is ejected using a nozzle 32 in the region of each pass to the regulated use amount is set as a nozzle use rate (%), a total of a nozzle use rate of the nozzle 32 in the first pass, and a nozzle use rate of the nozzles 32 in the second pass becomes "100%". In addition, in the following descriptions, there is a case in which a nozzle use rate of each nozzle 32 which is illustrated in FIG. 3A is referred to as a "nozzle use rate at a normal time". In addition, the above described nozzle use rate at a normal time is similarly set with respect to the nozzle columns 31C, 31M, and 31Y.

In addition, as illustrated in FIG. 4, the printer 11 includes a control device 40 for controlling operations of the printer 11. The control device 40 includes a CPU, a RAM, a ROM, and the like, and the CPU executes various control programs or processing programs which are stored in the ROM, or the like. The control device 40 is configured by including a printing control section 41, a transport control section 44, and the like, as an example of a control section.

In addition, a printing job which is generated by the host computer 100 is input to the control device 40. The printing control section 41 and the transport control section 44 of the control device 40 control an ejecting state of ink from the ejecting head 30, and a transport state of a sheet P using the transport motor 21 based on the printing job.

The printing control section 41 includes a complementing nozzle setting section 42 which performs setting so that ink is ejected using a complementing nozzle as a substitute nozzle of a defective nozzle, and a mask pattern changing section 43 which changes an ejecting state of ink of each nozzle 32 in order to set the complementing nozzle, in the same pixel as the pixel to which the defective nozzle should eject ink.

A detection signal of the abnormal ejecting detection section 33 is input to the printing control section 41. The printing control section 41 detects a defective nozzle in each nozzle 32 of the ejecting head 30 based on the detection signal. As an example of the detecting method, it is possible to use an abnormal ejecting detecting method which is described in Japanese Patent No. 3794431.

Figure 5A:
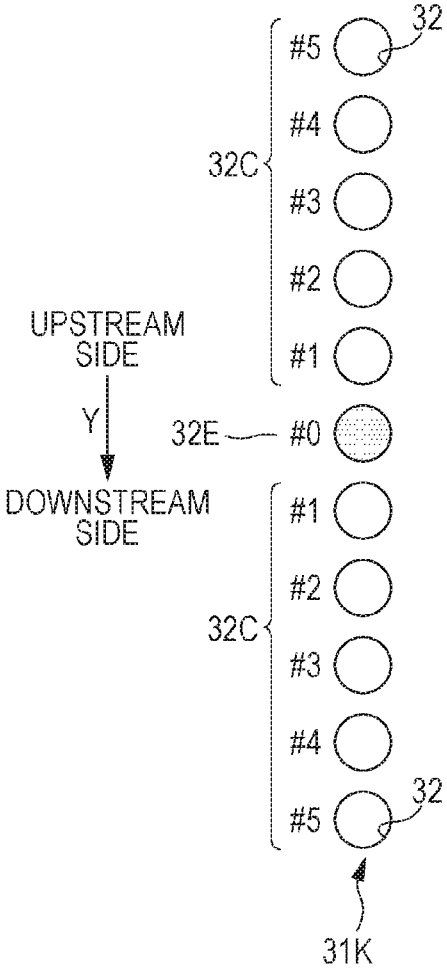
FIG. 5A is a schematic view which illustrates a part of a nozzle column in the first pass in a case in which a defective nozzle is present.
Figure 5B:
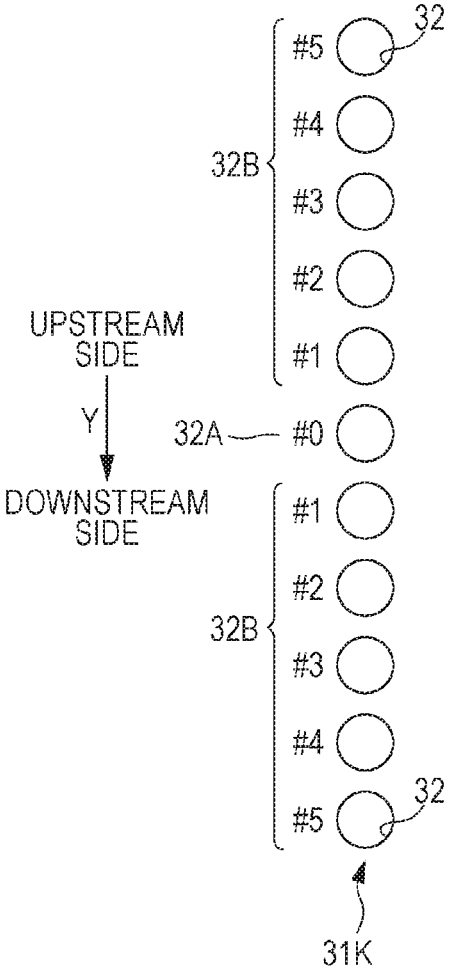
FIG. 5B is a schematic view which illustrates a part of a nozzle column in the second pass.

As illustrated in FIG. 5A, when a defective nozzle 32E is detected in the nozzle column 31K, as an example, the complementing nozzle setting section 42 sets a complementing nozzle (hereinafter, referred to as "complementing nozzle 32A") which can drop ink droplets to the same pixel as the pixel to which the defective nozzle 32E should eject ink as illustrated in FIG. 5B. In addition, hereinafter, descriptions will be made on the premise that the defective nozzle 32E is detected in the nozzle column 31K.

In addition, the complementing nozzle setting section 42 sets the peripheral nozzle (hereinafter, referred to as "peripheral nozzle 32C") of the defective nozzle 32E in the nozzle column 31K, and the peripheral nozzle of the complementing nozzle 32A (hereinafter, referred to as "supplementary complementing nozzle 32B") in the nozzle column 31K. As is denoted by Nos. 1 to 5 in FIG. 5A, the peripheral nozzle 32C is configured of a nozzle which is adjacent to the defective nozzle 32E, and a plurality of nozzles which are continuously adjacent to each other from the adjacent nozzle, like the five nozzles 32 on the upstream side in the transport direction Y and the five nozzles 32 on the downstream side in the transport direction Y with the defective nozzle 32E as the center. As is denoted by Nos. 1 to 5 in FIG. 5B, the supplementary complementing nozzle 32B is configured of a nozzle which is adjacent to the complementing nozzle 32A, and a plurality of nozzles which are continuously adjacent to each other from the adjacent nozzle, like the five nozzles 32 on the upstream side in the transport direction Y and the five nozzles 32 on the downstream side in the transport direction Y with the complementing nozzle 32A as the center. The supplementary complementing nozzle 32B can drop ink droplets to the same pixel as the pixel to which the peripheral nozzle 32C ejects ink. In addition, also in a case in which a defective nozzle is detected in the nozzle columns 31C, 31M, and 31Y, the same setting as those of the complementing nozzle 32A, the supplementary complementing nozzle 32B, and the peripheral nozzle 32C in the nozzle column 31K is performed.

The printing control section 41 prepares a mask pattern in which a nozzle use rate of each nozzle 32 is regulated for each pass, and sets an ejecting state of ink per one pass based on the mask pattern, with reference to FIGS. 4 to 5B. In addition, the printing control section 41 prepares a mask pattern which is stored in the RAM (hereinafter, referred to as "normal mask pattern"), for example, when a defective nozzle is not detected, and each nozzle 32 (refer to FIGS. 2A and 2B) ejects ink based on the mask pattern. Meanwhile, in the printing control section 41, when the defective nozzle 32E is detected, the complementing nozzle setting section 42 sets the complementing nozzle 32A. Thereafter, the mask pattern changing section 43 changes the normal mask pattern to a mask pattern (hereinafter, referred to as "changed mask pattern") which includes the complementing nozzle 32A, or the like, which can drop ink droplets to the same pixel as the pixel to which the defective nozzle 32E should eject ink.

The mask pattern changing section 43 generates a changed mask pattern using a table which denotes a relationship among a nozzle use rate of the complementing nozzle 32A (hereinafter, referred to as "nozzle use rate of first complementing nozzle"), a nozzle use rate of the supplementary complementing nozzle 32B (hereinafter, referred to as "nozzle use rate of second complementing nozzle"), and a nozzle use rate of the peripheral nozzle 32C (hereinafter, referred to as "nozzle use rate of peripheral nozzle") which is exemplified in FIG. 6. As illustrated in FIG. 6, the nozzle use rate of the second complementing nozzle is set to a value which is lower than the nozzle use rate of the first complementing nozzle, and is set to a low value when being a nozzle 32 which is separated from the complementing nozzle 32A in the nozzle column direction (transport direction Y), among the supplementary complementing nozzles 32B. In addition, the nozzle use rate of the peripheral nozzle is set to a value which is higher than that of the defective nozzle 32E, and is lower than the nozzle use rate of the first complementing nozzle and the nozzle use rate at a normal time, and is set to a high value when being a nozzle 32 which is separated from the defective nozzle 32E in the nozzle column direction (transport direction Y), among the peripheral nozzles 32C.

Figure 7A:
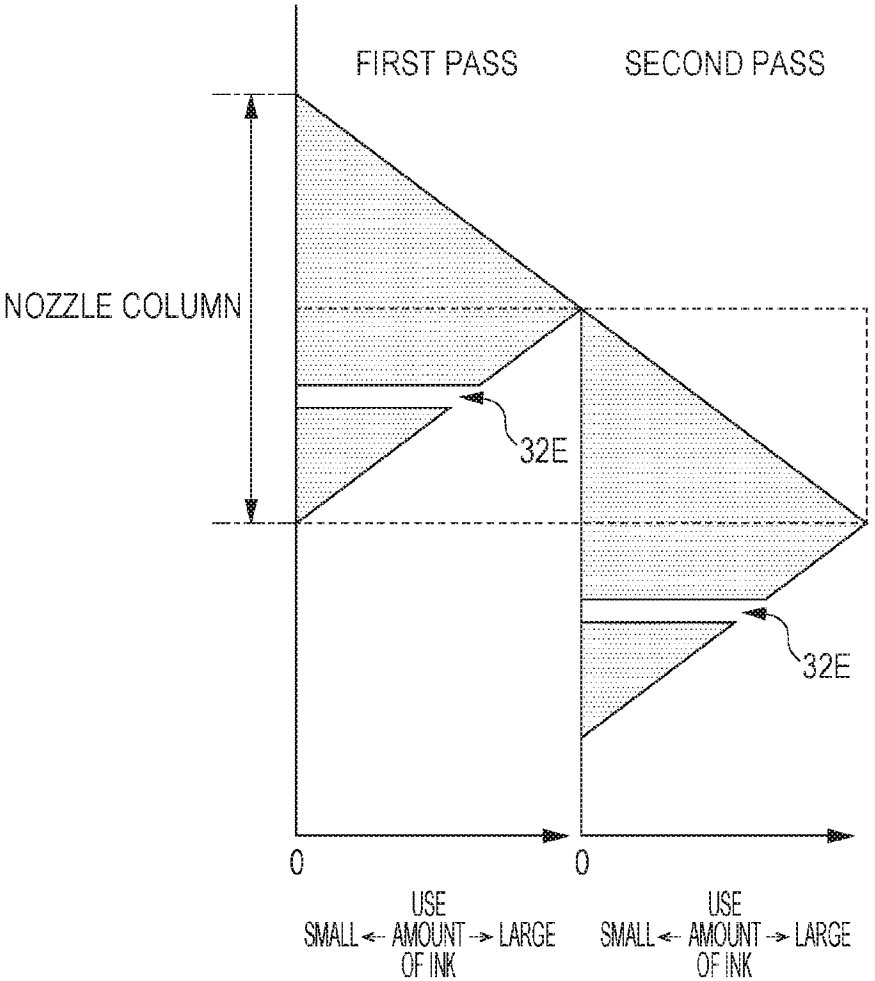
FIG. 7A is a schematic view which illustrates a relationship between a nozzle column and a use amount of ink when ink is ejected from each nozzle based on a normal mask pattern in a case in which a defective nozzle is detected, in the liquid ejecting apparatus.
Figure 7B:
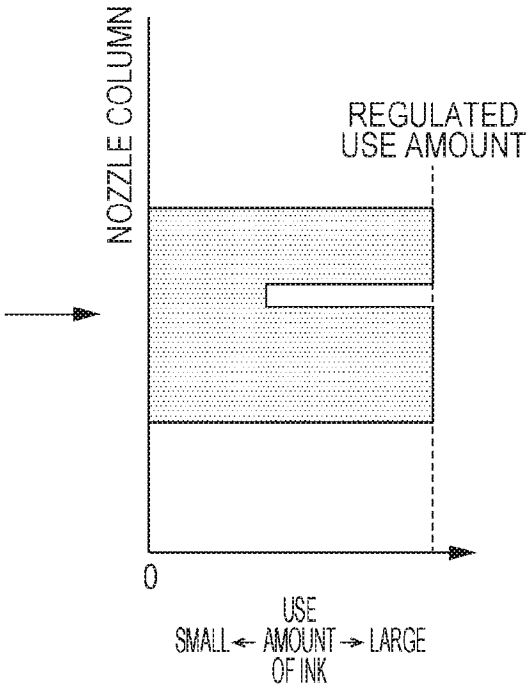
FIG. 7B is a schematic view which illustrates a relationship between a nozzle column in a region which is illustrated using a dashed line in FIG. 7A and a total use amount of ink in the first pass and the second pass.

As illustrated in FIG. 7A, in the normal mask pattern, when a defective nozzle 32E is generated, an amount of ink of the defective nozzle 32E becomes "zero". For this reason, as illustrated in FIG. 7B, even when it is assumed that printing is performed in a two-pass printing mode using the normal mask pattern, an amount of ink of a dot which is formed in a region corresponding to a pixel to which the defective nozzle 32E should perform ejecting on a sheet P becomes excessively low.

Figure 8A:
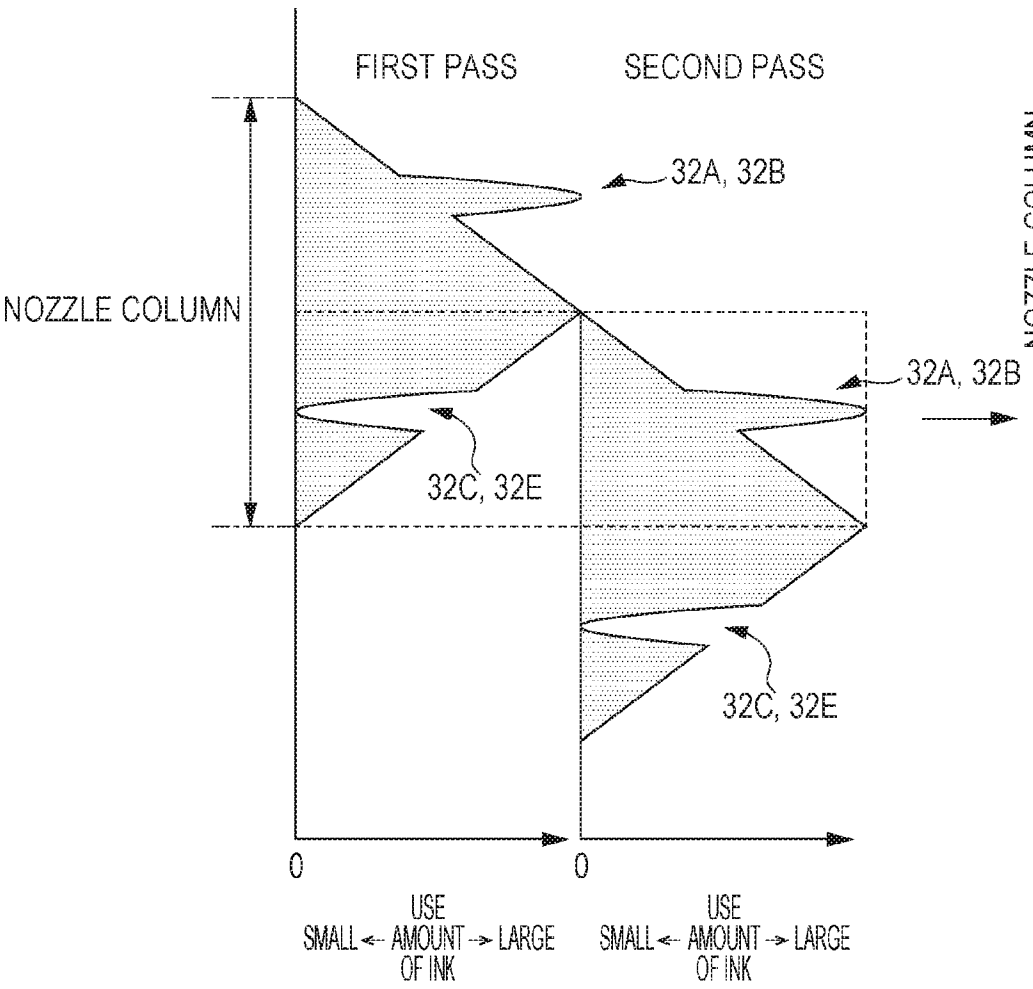
FIG. 8A is a schematic view which illustrates a relationship between a nozzle column and a use amount of ink when ink is ejected from each nozzle based on a changed mask pattern in a case in which a defective nozzle is detected, in the liquid ejecting apparatus.
Figure 8B:
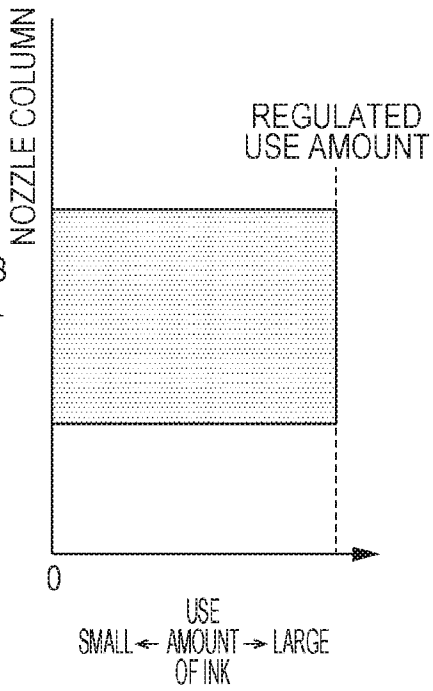
FIG. 8B is a schematic view which illustrates a relationship between a nozzle column in a region which is illustrated using a dashed line in FIG. 8A and a total use amount of ink in the first pass and the second pass.

In such a case, as illustrated in FIG. 8A, in the changed mask pattern, an amount of ink of the defective nozzle 32E becomes "zero", and a valley shape is formed as if an amount of ink of the peripheral nozzle 32C increases by being separated from the defective nozzle 32E in the transport direction Y. Meanwhile, in the changed mask pattern, an amount of ink of the complementing nozzle 32A becomes the regulated use amount, and a mountain shape is formed as if an amount of ink of the supplementary complementing nozzle 32B decreases by being separated from the complementing nozzle 32A in the transport direction Y. In addition, a valley shape and a mountain shape are formed so that a total use rate of the nozzle use rate of the defective nozzle 32E and the nozzle use rate of the first complementing nozzle, and a total use rate of the nozzle use rate of the peripheral nozzle and the nozzle use rate of the second complementing nozzle become "100", respectively, that is, as illustrated in FIG. 8B, a total of an amount of ink in the first pass and an amount of ink in the second pass of the ejecting head 30 becomes the regulated use amount.

Figure 9:
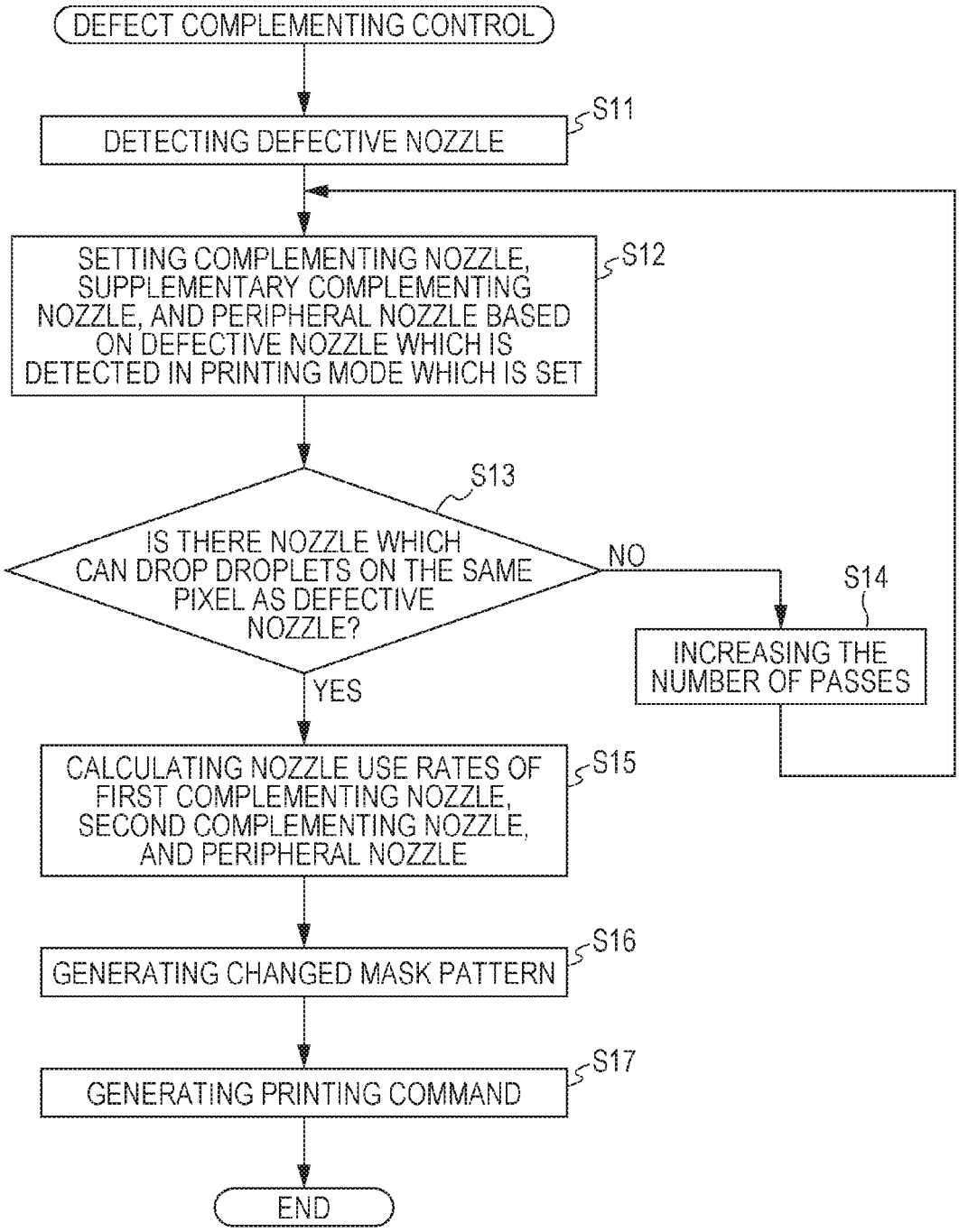
FIG. 9 is a flowchart which describes a failure complementing control which is performed by the liquid ejecting apparatus.

In addition, the printing control section 41 (refer to FIG. 4) forms a changed mask pattern from the normal mask pattern when the defective nozzle 32E (refer to FIGS. 5A and 5B) is detected, and executes a defect complementing control which controls an ejecting state of ink using the ejecting head 30 (refer to FIGS. 2A and 2B) based on the changed mask pattern. The printing control section 41 receives a printing job from the host computer 100 (refer to FIG. 4), and then executes a defect complementing control before executing printing of an image, or the like, on a sheet P based on the printing job. The defect complementing control is executed according to a processing procedure in the flowchart in FIG. 9. In addition, in the following descriptions, each constituent element of the printer 11 to which a reference numeral is attached denotes each constituent element of the printer 11 in FIG. 1 to FIG. 2B and FIG. 4.

First, the printing control section 41 detects a defective nozzle from a nozzle 32 of the ejecting head 30 based on a detection signal of the abnormal ejecting detection section 33 (step S11). In addition, the printing control section 41 sets a complementing nozzle, a supplementary complementing nozzle, and a peripheral nozzle in a set printing mode based on the detected defective nozzle (step S12). For example, as illustrated in FIG. 5A, in a case in which the printing mode is set to a two-pass printing mode, when one defective nozzle 32E is detected, the complementing nozzle 32A, the supplementary complementing nozzle 32B, and the peripheral nozzle 32C are set as illustrated in FIGS. 5A and 5B.

Subsequently, the printing control section 41 determines whether or not there is a nozzle which can drop ink droplets on the same pixel as the pixel to which the defective nozzle should eject ink (step S13). Here, for example, as illustrated in FIGS. 5A and 5B, in a case in which the complementing nozzle 32A itself as the nozzle which can drop ink droplets on the same pixel as the pixel to which the defective nozzle 32E should eject ink is a defective nozzle, it is determined that there is no nozzle which can drop ink droplets on the same pixel as the pixel to which the defective nozzle 32E should eject ink. Meanwhile, in a case in which the complementing nozzle 32A itself is not a defective nozzle, it is determined that there is a nozzle which can drop ink droplets on the same pixel as the pixel to which the defective nozzle 32E should eject ink.

The printing control section 41 increases the number of passes in the multipass printing mode (step S14), when it is determined that there is no nozzle which can drop ink droplets on the same pixel as the pixel to which the defective nozzle should eject ink (No in step S13), and returns to step S12. In this manner, by increasing the number of passes in the multipass printing mode, a nozzle other than the complementing nozzle 32A is set to the nozzle which can drop ink droplets on the same pixel as the pixel to which the defective nozzle 32E should eject ink.

Meanwhile, the printing control section 41 respectively calculates a nozzle use rate of the first complementing nozzle, a nozzle use rate of the second complementing nozzle, and a nozzle use rate of the peripheral nozzle (step S15) in a state in which the number of passes in the multipass printing mode is maintained, when it is determined that there is the nozzle which can drop ink droplets on the same pixel as the pixel to which the defective nozzle 32E should eject ink (Yes in step S13). In addition, the printing control section 41 generates a changed mask pattern from the normal mask pattern based on these nozzle use rates (step S16), and generates a printing command for performing printing on a sheet P using the ejecting head 30 based on the changed mask pattern (step S17).

Figure 10A:
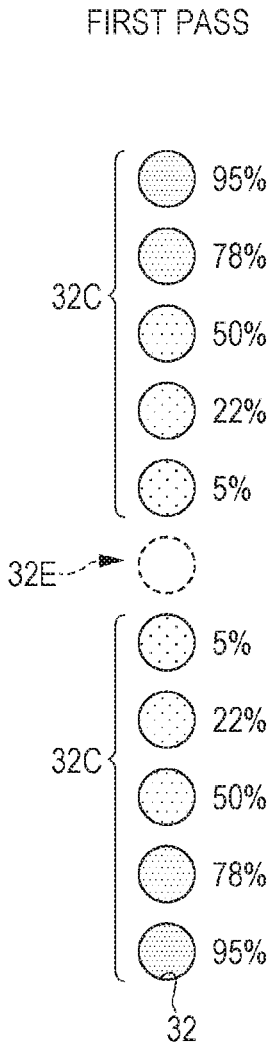
Figure 10B:
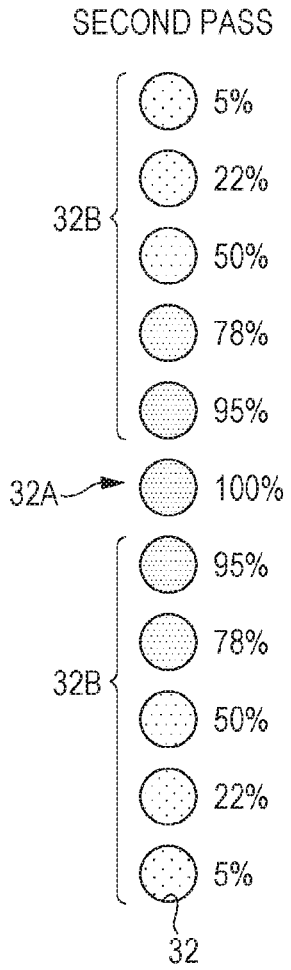
Figure 10C:
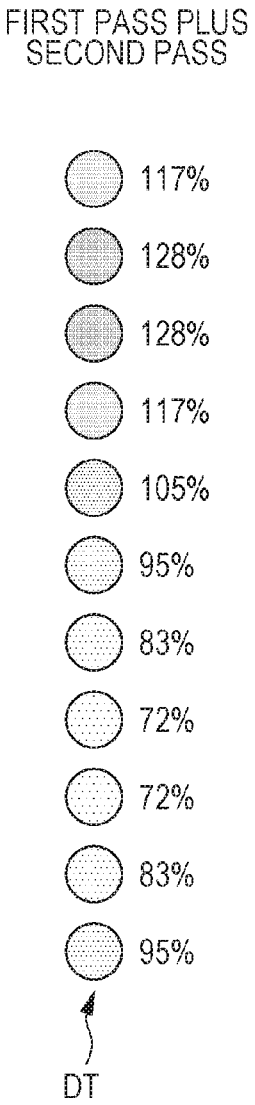

Subsequently, operations of the printer 11 according to the embodiment will be described using FIGS. 10A to 10C.

The printing control section 41 controls an ejecting state of ink of the ejecting head 30 so that an amount of ink of all of pixels to which ink is ejected becomes the regulated use amount by executing the defect complementing control. For example, in a case of the two-pass printing mode, as illustrated in FIG. 10A, when a defective nozzle 32E is detected in nozzles 32 in the first pass, the peripheral nozzle 32C as the peripheral nozzle of the defective nozzle 32E is set. In addition, as illustrated in FIG. 10B, a complementing nozzle 32A as a nozzle which can drop ink droplets on the same pixel as the pixel to which a defective nozzle 32E should eject ink, and a supplementary complementing nozzle 32B as the peripheral nozzle of the complementing nozzle 32A are set, in nozzles 32 in the second pass. In addition, as denoted in the table in FIG. 6, each nozzle use rate is set so that a total nozzle use rate of the nozzle use rate of the defective nozzle 32E and the nozzle use rate of the first complementing nozzle as the complementing nozzle 32A, and a total nozzle use rate of the nozzle use rate of the peripheral nozzle as the peripheral nozzle 32C and the nozzle use rate of the second complementing nozzle as the supplementary complementing nozzle 32B become "100%", respectively.

Meanwhile, when a printing region in a sheet P in the first pass is transported to regions of the nozzle columns 31K, 31C, 31M, and 31Y of the ejecting head 30 in the second pass due to a position shift of the sheet P with respect to the ejecting head 30 because of an error in transporting the sheet P, there is a case in which a positional relationship between the printing region and a nozzle 32 is slightly shifted in the transport direction Y. Due to this, as illustrated in FIG. 10B, for example, when the sheet P is shifted by one nozzle in the transport direction Y with respect to the ejecting head 30 at a time of performing printing in the second pass using the ejecting head 30, as illustrated in FIG. 10C, each total nozzle use rate does not become "100%".

Figure 13B:
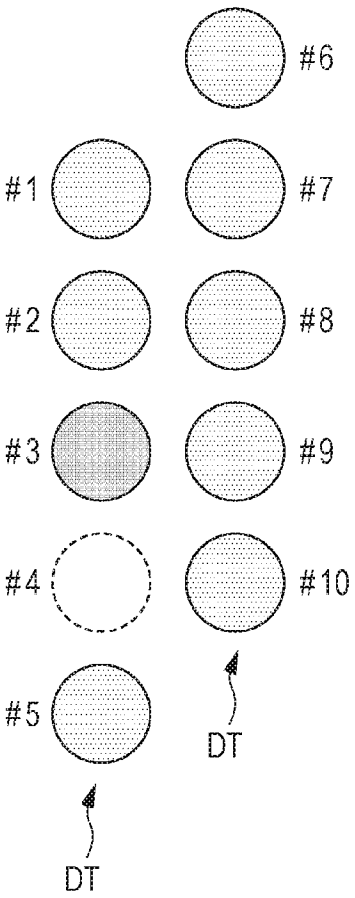
FIG. 13B is a schematic view when ink is ejected to the medium in a defective nozzle and other nozzles in the second pass in FIG. 13A.
Figure 13A:
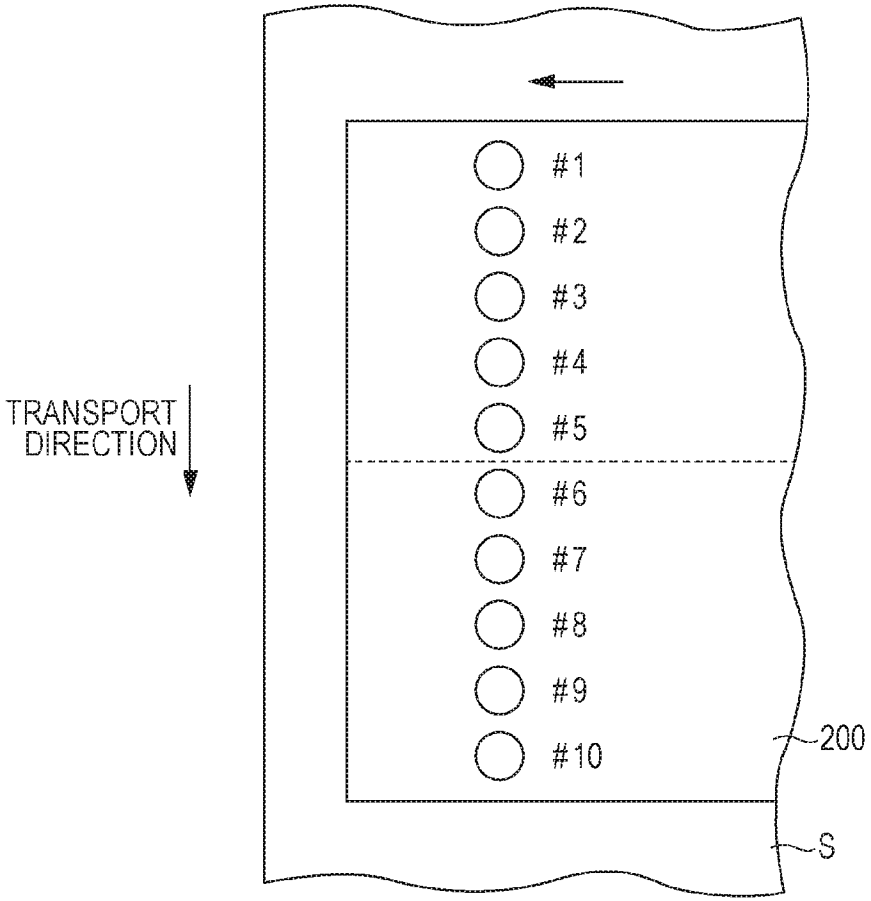
FIG. 13A is a schematic view which illustrates a positional relationship between an ejecting head and a medium in the liquid ejecting apparatus in the related art.

However, a nozzle use rate of the peripheral nozzle which is adjacent to the defective nozzle 32E in the peripheral nozzles 32C is as small as "5%". For this reason, even when the complementing nozzle 32A ejects ink in a region to which the peripheral nozzle 32C which is adjacent to the defective nozzle 32E eject ink on the sheet P, a total nozzle use rate of the peripheral nozzle 32C and the complementing nozzle 32A becomes "105%". Accordingly, it is possible to prevent an amount of ink of a dot DT which is formed in the region from becoming excessively large with respect to the regulated use amount. In addition, a nozzle use rate of the second complementing nozzle as the supplementary complementing nozzle 32B which is adjacent to the complementing nozzle 32A is as large as "95%". For this reason, even when the supplementary complementing nozzle 32B which is adjacent to the complementing nozzle 32A ejects ink in a region corresponding to the pixel to which the defective nozzle 32E should eject ink on the sheet P, a total nozzle use rate of the supplementary complementing nozzle 32B and the defective nozzle 32E becomes "95%". Accordingly, it is possible to prevent an amount of ink of a dot DT which is formed in the region from becoming excessively small with respect to the regulated use amount. Accordingly, as in the printer in the related art which is illustrated in FIGS. 13A and 13B, it is possible to prevent a difference in amount of ink between a dot DT which is formed in the region corresponding to the pixel to which the defective nozzle should eject ink and a dot DT which is formed in a region which is adjacent to the region from becoming excessively large on a medium (sheet).

In addition, since a nozzle use rate of the peripheral nozzle as the peripheral nozzle 32C is increased by being separated from the defective nozzle 32E in the transport direction Y, and meanwhile the nozzle use rate of the second complementing nozzle as the supplementary complementing nozzle 32B is decreased by being separated from the complementing nozzle 32A in the transport direction Y, it is possible to prevent the nozzle use rate from being excessively increased or decreased even when the transport error occurs. For this reason, a variation in amount of ink of a dot DT which is formed in a region which is adjacent to a sheet P in the transport direction Y decreases, and lightness and darkness of an image becomes inconspicuous. In addition, as illustrated in FIG. 10C, since a nozzle use rate is changed while repeating an increase and decrease gradually in the transport direction Y, an amount of ink of a dot DT which is formed in the transport direction Y is changed while repeating an increase and decrease gradually in the transport direction Y. For this reason, a variation in amount of ink of a dot DT decreases, and lightness and darkness of an image becomes inconspicuous.

According to the printer 11 in the embodiment, it is possible to obtain the following effects.

(1) The printing control section 41 sets the complementing nozzle 32A, and the supplementary complementing nozzle 32B as the peripheral nozzle of a nozzle column of the complementing nozzle 32A using the complementing nozzle setting section 42. For this reason, in a case of printing a raster line of one column on a sheet P using a plurality of times of scanning of the ejecting head 30, even when the complementing nozzle 32A is incapable of ejecting ink to a region corresponding to the pixel to which the defective nozzle 32E should eject ink on the sheet P due to an error in transporting the sheet P, the supplementary complementing nozzle 32B can eject ink to the region. For this reason, it is possible to suppress deterioration in image quality since a difference in amount of ink between a dot DT which is formed in the region corresponding to the pixel to which the defective nozzle 32E should eject ink on the sheet P and a dot DT which is formed in the peripheral region thereof decreases.

(2) In the printing control section 41, it is set so that a total of the nozzle use rate of the first complementing nozzle and the nozzle use rate of the defective nozzle 32E for forming a raster line of one column is the same as a total of the nozzle use rates at the normal time for forming a raster line of one column. For this reason, when there is no error in transporting of a sheet P, an amount of ink of a dot DT which is formed in the region corresponding to the pixel to which the defective nozzle 32E should eject ink on the sheet P, and an amount of ink of a dot DT which is formed using a normal nozzle 32 become equal. For this reason, it is possible to suppress deterioration in image quality.

(3) The printing control section 41 sets the nozzle use rate of the peripheral nozzle 32C as the peripheral nozzle 32C of the defective nozzle 32E to a nozzle use rate which is lower than a nozzle use rate at a normal time. For this reason, a dot DT with a small amount of ink is formed when the peripheral nozzle 32C with a low nozzle use rate eject ink with respect to the peripheral region of the region corresponding to the pixel to which the defective nozzle 32E should eject ink on the sheet P. In addition, even when a position of the sheet P with respect to the ejecting head 30 is shifted due to an error in transporting of the sheet P thereafter, and the complementing nozzle 32A eject ink to the peripheral region on the sheet P, it is possible to prevent an amount of ink of a dot DT which is formed in the peripheral region thereof from excessively increasing. Accordingly, a variation in amount of ink between the dot DT which is formed in the region corresponding to the pixel to which the defective nozzle 32E should eject ink on the sheet P and the dot DT which is formed in the peripheral region thereof is suppressed. For this reason, it is possible to suppress deterioration in image quality.

(4) The printing control section 41 sets a nozzle use rate of the peripheral nozzle as the peripheral nozzle 32C to be high when being separated from the defective nozzle 32E in the nozzle column direction, and sets a nozzle use rate of the second complementing nozzle as the supplementary complementing nozzle 32B to be low when being separated from the complementing nozzle 32A in the nozzle column direction. For this reason, even when a position of a sheet P with respect to the ejecting head 30 is shifted due to an error in transporting of the sheet P, or the like, since the complementing nozzle 32A eject ink to the region corresponding to a pixel with a low nozzle use rate of the peripheral nozzle on the sheet P, it is possible to prevent an amount of ink of a dot DT which is formed in the region from becoming excessively large. In addition, since ink is ejected to a region corresponding to the pixel to which the defective nozzle 32E should eject ink on the sheet P, using the second complementing nozzle with the high nozzle use rate among the supplementary complementing nozzles 32B, it is possible to prevent an amount of ink of a dot DT which is formed in the region from becoming excessively small. In this manner, respective variations in amount of ink of the dot DT which is formed in the region corresponding to the pixel to which the defective nozzle 32E should eject ink on the sheet P, and an amount of ink of the dot DT which is formed in the peripheral region thereof are decreased. Accordingly, lightness and darkness of a dot DT which is formed on the sheet P is reduced, and it is possible to further suppress deterioration in image quality.

(5) In the printing control section 41, it is set so that a total of the nozzle use rate of the second complementing nozzle and the nozzle use rate of the peripheral nozzle for forming a raster line of one column is equal to a total of the nozzle use rates at the normal time for forming a raster line of one column. For this reason, when there is no error in transporting of a sheet P, an amount of ink of a dot DT which is formed in the region corresponding to the pixel to which the defective nozzle 32E should eject ink on the sheet P becomes equal to an amount of ink of a dot DT which is formed using a normal nozzle 32. For this reason, it is possible to further suppress deterioration in image quality.

(6) The printing control section 41 sets an amount of ink of a nozzle 32 so that an amount of ink which is ejected from a nozzle 32 becomes small toward both ends from the center of the nozzle columns 31K, 31C, 31M, and 31Y in the transport direction Y. For this reason, in a case in which a position of a sheet P with respect to the ejecting head 30 is shifted in the transport direction Y due to an error in transporting of the sheet P, for example, it is possible to it is possible to reduce a degree of influences compared to a case in which a nozzle use rate of a nozzle column is constant.

(7) The printing control section 41 sets a nozzle which can drop ink droplets on the same pixel as the pixel to which the defective nozzle 32E should eject ink by increasing the number of passes of the ejecting head 30, in a case in which there is no nozzle which can drop ink droplets on the same pixel as the pixel to which the defective nozzle 32E should eject ink. Due to this, it is possible to reduce the frequency of not ejecting ink to the same pixel as the pixel to which the defective nozzle 32E should eject ink.

Modification Example

The above described embodiment may be changed to another embodiment below.

Figure 11:
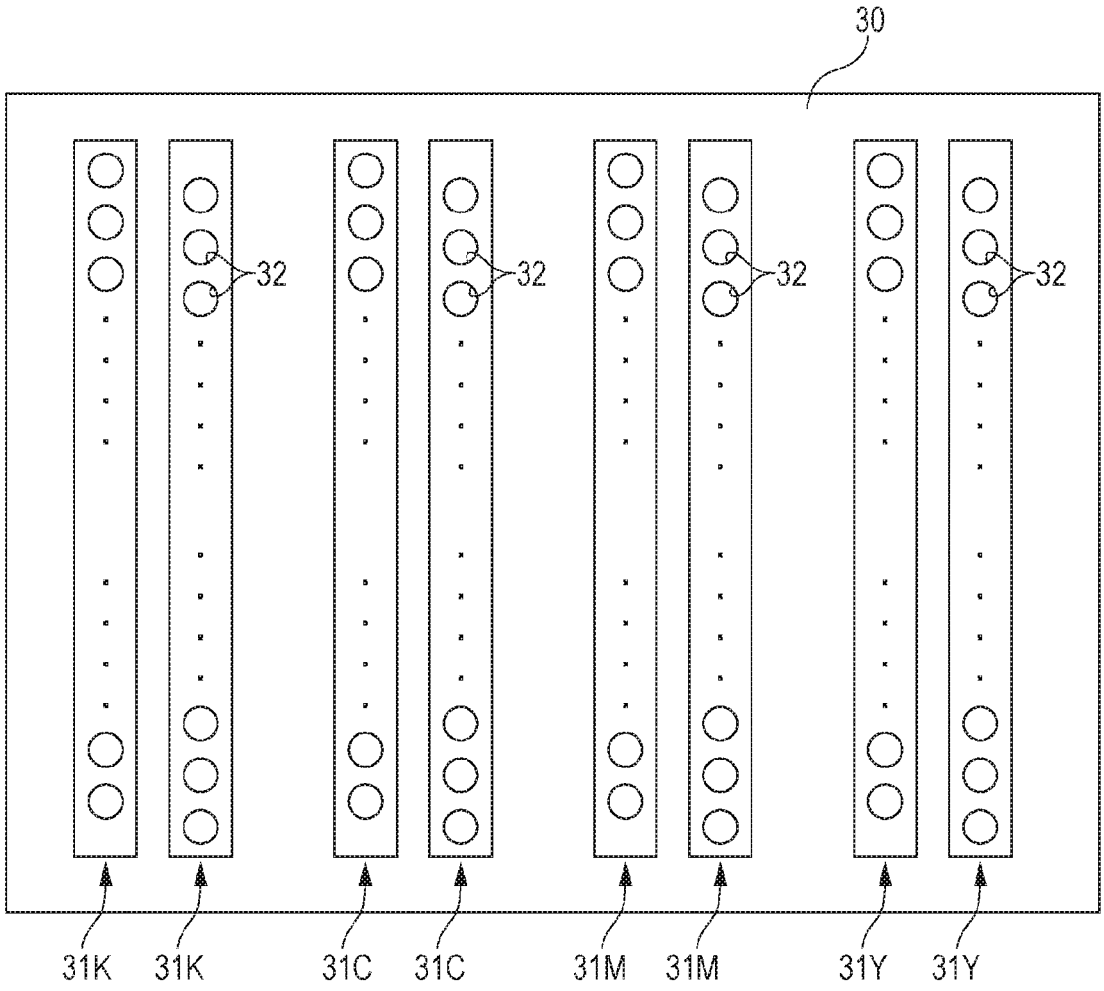
FIG. 11 is a base view of an ejecting head in a modification example.
Figure 12B:
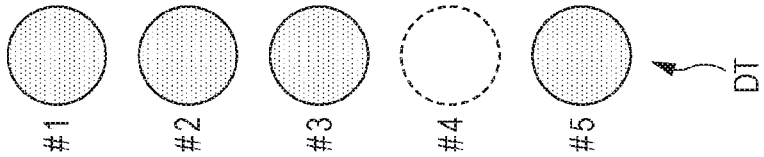
FIG. 12B is a schematic view when ink is ejected to the medium in a defective nozzle and other nozzles in the first pass in FIG. 12A.
Figure 12A:
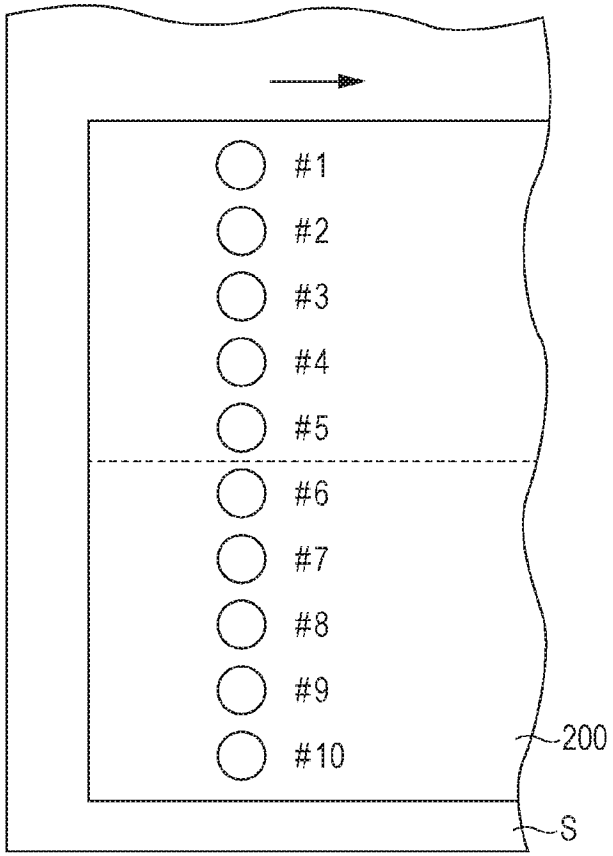
FIG. 12A is a schematic view which illustrates a positional relationship between an ejecting head and a medium in a liquid ejecting apparatus in the related art.

The nozzle columns 31K, 31C, 31M, and 31Y of the ejecting head 30 according to the embodiment may be configured using two nozzle columns in each color as illustrated in FIG. 11. In this case, as a supplementary complementing nozzle which is the peripheral nozzle of a complementing nozzle, a nozzle in a nozzle column on a side on which a complementing nozzle in the two nozzle columns is not allocated may be allocated. That is, the supplementary complementing nozzle may not be formed in the same nozzle column as the complementing nozzle.

In the above described embodiment, a nozzle use rate of a nozzle at the periphery (peripheral nozzle) of a defective nozzle in a nozzle column may be set to a nozzle use rate at a normal time, instead of a nozzle use rate of the peripheral nozzle when the defective nozzle is detected.

In the above described embodiment, a nozzle use rate of each nozzle 32 of the nozzle columns 31K, 31C, 31M, and 31Y may be constant.

In a detecting method of a defective nozzle according to the above described embodiment, for example, a user may visually detect a defective nozzle from a check pattern by printing the check pattern before printing an image based on a printing job. In this case, the user operates an operation unit (not illustrated) of the printer 11, and registers the defective nozzle. In addition, the printing control section 41 generates a changed mask pattern based on information of the registered defective nozzle.

In the above described embodiment, the number of supplementary complementing nozzles 32B can be arbitrarily set. For example, the number of supplementary complementing nozzles 32B may be two to four, or six or more.

In the above described embodiment, the number of peripheral nozzles 32C can be arbitrarily set. For example, the number of peripheral nozzle 32C may be two to four, or six or more. In addition, the number of peripheral nozzles 32C may be different from that of the supplementary complementing nozzle 32B.

In the above described embodiment, a nozzle use rate of the first complementing nozzle can be arbitrarily set. That is, the nozzle use rate of the first complementing nozzle may be a value which is less than "100%".

In the above described embodiment, nozzle use rates of the second complementing nozzle and the peripheral nozzle can be arbitrarily set.

For example, a nozzle use rate of the second complementing nozzle according to the embodiment is lowered when the second complementing nozzle is separated from a complementing nozzle 32A; however, it is not limited to this, and the nozzle use rate may be constantly set regardless of a position of the supplementary complementing nozzle 32B. Similarly, a nozzle use rate of the peripheral nozzle may be set to be constant regardless of a position of the peripheral nozzle 32C.

In addition, for example, a total nozzle use rate of the second complementing nozzle and the peripheral nozzle in the embodiment is set to "100%"; however, it is not limited to this, and may be set to a value other than "100%".

In the above described embodiment, the printing control section 41 may set printing modes of three passes or more as a multipass printing mode. In this case, since there are two or more nozzles which can drop ink droplets to the same pixel as the pixel to which a defective nozzle 32E eject ink, these nozzles may be set to the complementing nozzle 32A. In this manner, dots DT are formed in a region corresponding to the pixel to which the defective nozzle 32E should eject ink on a sheet P using the plurality of complementing nozzles 32A. For this reason, it is possible to lower a nozzle use rate of the complementing nozzle 32A, or a use frequency of the complementing nozzle 32A compared to the two-pass printing mode. Accordingly, it is possible to prevent the service life of the complementing nozzle 32A from being shortened.

In the above described embodiment, the printer 11 is not limited to a configuration of including only a printing function, and may be a multifunction printer. In addition, the printer 11 may be a printer of a lateral scanning type without being limited to a serial printer.

A medium is not limited to a sheet P, and may be a continuous sheet, a resin film, metallic foil, a metallic film, a composite film of a resin and metal (laminated film), a woven stuff, non-woven fabric, a ceramic sheet, and the like.

In the above described embodiment, a liquid ejecting apparatus has been embodied as an ink jet printer (printing apparatus); however, it is not limited to this, and may be a liquid ejecting apparatus which ejects fluid other than ink (including liquid, liquid body which is formed by dispersing or mixing particles of functional material into liquid, and liquid body such as gel). For example, the liquid ejecting apparatus may be a liquid ejecting apparatus which ejects a liquid body including a material such as an electrode material, or a coloring material (pixel material) which is used when manufacturing, for example, a liquid crystal display, an EL (electroluminescence) display, and a surface emission display, or the like, in a form of dispersion, or dissolution. In addition, the liquid ejecting apparatus may be a liquid ejecting apparatus which ejects a biological organic substance which is used when manufacturing a biochip, or a liquid ejecting apparatus which ejects liquid as a sample which is used as a precision pipette. In addition, the liquid ejecting apparatus may be a liquid ejecting apparatus which ejects a lubricant to a precision machine such as a clock, a camera, or the like, using a pinpoint, a liquid ejecting apparatus which ejects transparent resin liquid such as UV curable resin for forming a micro bulls-eye (optical lens) which is used in an optical communication element, or the like, onto a substrate, and a liquid ejecting apparatus which ejects an etching liquid such as an acid or alkali for etching a substrate, or the like. Further, the liquid ejecting apparatus may be a liquid ejecting apparatus which manufactures a three-dimensional structure by ejecting liquid.

This application claims priority to Japanese Patent Application No. 2015-068260 filed on Mar. 30, 2015. The entire disclosure of Japanese Patent Application No. 2015-068260 is hereby incorporated herein by reference.

What is claimed is:

1. A liquid ejecting apparatus comprising:

an ejecting head which includes nozzle columns formed by aligned nozzles, the nozzles selectively ejecting liquid onto a medium;

a moving mechanism configured to move the ejecting head relative to the medium;

an abnormal ejecting detector configured to detect a defective nozzle among the nozzles, the defective nozzle ejecting the liquid abnormally in an abnormal operation;

a memory configured to store computer-readable instructions; and a processor configured to execute the computer-readable instructions so as to:

control operations of the ejecting head and the moving mechanism; and cause the ejecting head to eject the liquid to the medium while performing scanning a plurality of times with respect to a predetermined raster line extending in a direction intersecting the nozzle columns, wherein when the defective nozzle is detected by the abnormal ejecting detector, the processor is configured to:

identify a main complimenting nozzle and a peripheral complimenting nozzle, the peripheral complimenting nozzle is located directly adjacent to the main complimenting nozzle, the main complimenting nozzle is assigned to a same raster line in which the defective nozzle is located;

set a first complimenting nozzle use rate of the main complementing nozzle during the abnormal operation to be higher than a regular nozzle use rate of the main complementing nozzle during a normal operation, and set a second complimenting nozzle use rate of the peripheral complementing nozzle during the abnormal operation to be lower than the first complimenting nozzle use rate of the main complementing nozzle.

2. The liquid ejecting apparatus according to claim 1, wherein the nozzles have a peripheral nozzle which is located directly adjacent to the defective nozzle, and an abnormal peripheral nozzle use rate of the peripheral nozzle in the abnormal operation is lower than a regular peripheral nozzle use rate of the peripheral nozzle during the normal operation.

3. The liquid ejecting apparatus according to claim 2, wherein the processor is configured to set the abnormal peripheral nozzle use rate of the peripheral nozzle to be higher as the peripheral nozzle is located far from the defective nozzle in a nozzle column direction, and the processor is configured to set the second complementing nozzle use rate of the peripheral complementing nozzle to be lower as the peripheral complementing nozzle is located far from the main complementing nozzle in the nozzle column direction.

4. The liquid ejecting apparatus according to claim 2, wherein the processor is configured to set a first sum of the second complementing nozzle use rate and the abnormal peripheral nozzle use rate of the peripheral nozzle during the abnormal operation is equal to a second sum of a regular nozzle use rate of the second complementing nozzle and the regular peripheral nozzle use rate of the peripheral nozzle during the normal operation.

5. A liquid ejecting method in a liquid ejecting apparatus, the liquid electing apparatus including:

an ejecting head which includes nozzle columns formed by aligned nozzles, the nozzles selectively ejecting liquid onto a medium;

a moving mechanism configured to move the ejecting head relative to the medium;

an abnormal ejecting detector configured to detect a defective nozzle among the nozzles, the defective nozzle ejecting the liquid in an abnormal operation;

a memory configured to store computer-readable instructions; and a processor configured to execute the computer-readable instructions so as to:

control operations of the ejecting head and the moving mechanism; and cause the ejecting head to eject the liquid onto the medium while performing scanning a plurality of times with respect to a predetermined raster line extending in a direction intersecting the nozzle columns, the liquid ejecting method for causing the processor to execute the computer-readable instructions, the liquid ejecting method comprising:

identify a main complimenting nozzle and a peripheral complimenting nozzle, the peripheral complimenting nozzle being located directly adjacent to the main complimenting nozzle, the main complimenting nozzle being assigned to a same raster line in which the defective nozzle is located;

setting a first complimenting nozzle use rate of the main complementing nozzle during the abnormal operation to be higher than a regular nozzle use rate of the main complementing nozzle during a normal operation; and setting a second complimenting nozzle use rate of the peripheral complementing nozzle during the abnormal operation to be lower than the first complementing nozzle use rate of the main complimenting nozzle.

* * * * *